US006617790B2

(12) United States Patent
Fidler et al.

(10) Patent No.: US 6,617,790 B2
(45) Date of Patent: Sep. 9, 2003

(54) METAL HALIDE LAMP WITH CERAMIC DISCHARGE VESSEL

(75) Inventors: Uwe Fidler, Berlin (DE); Karen Twesten, Berlin (DE)

(73) Assignee: Patent-Treuhand-Gesellschaft f. Elektrische Gluehlampen mbH, Munich (DE)

( * ) Notice: Subject to any disclaimer, the term of this patent is extended or adjusted under 35 U.S.C. 154(b) by 0 days.

(21) Appl. No.: 09/855,721

(22) Filed: May 16, 2001

(65) Prior Publication Data

US 2002/0008476 A1 Jan. 24, 2002

(30) Foreign Application Priority Data

May 31, 2000 (DE) ..... 100 26 802

(51) Int. Cl.[7] ..... H01J 17/18; H01J 61/36

(52) U.S. Cl. ..... 313/623; 313/622; 313/624; 313/625

(58) Field of Search ..... 313/622–625; 501/73

(56) References Cited

U.S. PATENT DOCUMENTS 5,404,077 A * 4/1995 Eichelbronner et al. .... 313/623
5,404,078 A * 4/1995 Bunk et al. ..... 313/625
5,424,608 A 6/1995 Juengst et al.
5,532,552 A 7/1996 Heider et al.
5,994,839 A * 11/1999 Yamamoto et al. ..... 313/570
6,528,945 B2 * 3/2003 Kelly et al. ..... 313/623

FOREIGN PATENT DOCUMENTS

EP 0 887 839 12/1998
EP 0 587 238 7/2000
JP 01052374 A * 2/1989 ..... H01J/61/36

* cited by examiner

*Primary Examiner*—Nimeshkumar D. Patel
*Assistant Examiner*—Anthony Perry
(74) *Attorney, Agent, or Firm*—William H. McNeill

(57) ABSTRACT

A metal halide lamp has a ceramic discharge vessel with two ends (5) which are closed off by sealing means which enclose a capillary tube (11). An electrically conductive lead-through (9) is passed in a vacuum-tight manner through a bore in the capillary tube (11). The capillary tube (11) comprises two sections (20, 21) which are arranged axially one behind the other, the diameter of the bore of the inner section amounting to at most 90% of the diameter of the bore in the outer section.

10 Claims, 2 Drawing Sheets

METAL HALIDE LAMP WITH CERAMIC DISCHARGE VESSEL

TECHNICAL FIELD

The invention is based on a metal halide lamp with ceramic discharge vessel in accordance with the preamble of claim 1. It relates in particular to a discharge vessel which is sealed by means of capillary tube. The discharge vessel may be accommodated in an outer bulb which is capped on one or two sides.

PRIOR ART

U.S. Pat. No. 5,424,608 has already disclosed a metal halide lamp with ceramic discharge vessel in which the opening in the stopper for the lead-through comprises two sections of different diameters. The diameter of the inner section which faces the discharge is smaller than that of the outer section. This construction is used to accommodate a lead-through which on the outside consists of a niobium tube which is surrounded by a soldering glass. The tube is protected from the aggressive substances of the fill. The inner section is significantly wider than the diameter of the electrode shank which it accommodates and the diameter of which is significantly smaller than that of the Nb tube. The inner section is very short, so that the dead volume situated between its bore and the shank of the electrode is very small.

U.S. Pat. No. 5,532,552 has disclosed a metal halide lamp with ceramic discharge vessel in which the opening in the stopper for the lead-through likewise comprises two sections of different diameters. The diameter of the inner section which faces the discharge is smaller than that of the outer section. This structure is used to accommodate a lead-through which comprises a solid niobium pin of constant diameter which is continuously surrounded by soldering glass. This is split into two, a first, halide-resistant soldering glass being introduced into the inner, narrowed section. The outer section is significantly wider than the inner section and contains a second soldering glass which has good sealing properties but is less able to resist halides. The step between the first and second sections serves to ensure that adhesive forces acting on the soldering glass can only occur in the gap of the inner section, with the result that the first soldering glass passes reliably into this inner section at the front and leaves the outer, wider section clear, the wider gap of this section being filled by the second soldering glass.

Another metal halide lamp (EP 887 839) has a stopper, in which a short capillary tube of constant bore diameter made from weldable, electrically conductive cermet is introduced into a stepped end region of a ceramic discharge vessel. One advantage of this construction is that backfiring of the discharge arc towards the short capillary tube is prevented. Moreover the step serves as a stop in order to hold the capillary tube in a blind bore. The tube is sintered in at the end region, i.e. soldering glass is not used. The lead-through is a pin of constant diameter consisting of cermet or metal, preferably molybdenum.

OUTLINE OF THE INVENTION

It is an object of the present invention to provide a metal halide lamp in accordance with the preamble of claim 1 which is distinguished by an improved operating performance.

This object is achieved by the characterizing features of claim 1. Particularly advantageous configurations are given in the dependent claims.

In known lamp structures with a long capillary tube (cf. for example EP-A 587 238), the internal diameter of the capillary tube is constant. This necessarily entails a relatively wide, continuous gap between the lead-through and the inner wall of the bore in the capillary tube, in order to leave space for the soldering glass. The introduction of a capillary tube whose bore, according to the invention, comprises two sections of different diameters on the one hand reduces the dead volume itself and on the other hand reduces the manufacturing deviations in this reduced dead volume. As a result, when the lamp is operating, the quantity of fill which has condensed in the dead volume and consequently is not active is reduced. Consequently, the temperature dependency of the colour temperature and of the colour locus is reduced, and the deviation of these parameters across an entire batch of lamps is also reduced. Moreover, on account of the smaller dead volume, the quantity of fill constituents to be introduced can be reduced, which ultimately increases the light flux.

These advantages occur in particular if a vertical burning position of the lamp is selected, since in this case the condensate, under the force of gravity, collects in the vicinity of the bottom capillary and fills the associated dead volume. In this case, in particular a capillary tube with stepped sections is sufficient if this tube is arranged at the bottom in the burning position. In this case, it is preferable to use a discharge vessel in an outer bulb which is capped on one side, since in this way the orientation of the lamp is fixed.

In detail, the invention relates to a metal halide lamp with ceramic discharge vessel, the discharge vessel having two ends which are closed off by sealing means which comprise a capillary tube, an electrically conductive lead-through being passed in a vacuum-tight manner through a bore in this capillary tube, to which lead-through an electrode with a shank is attached, which electrode projects into the interior of the discharge vessel. The capillary tube comprises two sections which are arranged axially one behind the other, the diameter of the bore of the inner section amounting to at most 90% of the diameter of the bore in the outer section. The lead-through comprises two parts which lie axially one behind the other and are associated with the two sections. Both sections are preferably an integral part of a capillary tube, in order to avoid leakages. On account of the small differences in diameter of the bores, producing them from a single piece involves only little additional abrasion of material during drilling.

In particular, the length of the capillary tube (11) corresponds to at least the length of the spacing between the electrodes. The diameter of the bore of the inner section is advantageously at least 80% of the diameter of the bore in the outer section.

The length of the outer section is typically at least 4 mm and at most 6 mm.

The ratio of the lengths between the inner and outer sections is at least 1 and in particular is between 1 and 3.

The power consumption of the lamp is preferably at most 150 W.

Based on the discharge, the lead-through has an inner part and an outer part, the inner part containing molybdenum (in pure form or in a proportion of at least 30%, for example as a cermet), while the outer part consists of niobium. The inner part may also be manufactured from a plurality of components, in particular a pin with a filament.

To obtain a dead volume which is as small as possible, the ratio between the diameter of the inner part and the diameter of the inner section should be from 0.90 to 0.98.

On the other hand, this ratio may be significantly greater on the outside: the ration between the diameter of the outer part and the diameter of the outer section should be between 0.75 and 0.92 in order to leave sufficient space for the soldering glass.

In detail, the capillary tube is typically at least 10 mm long (for example 15 mm long) and is therefore longer than the distance between the electrodes (which is typically 5 mm). The length of the capillary tube is advantageously between one and three times the distance between the electrodes. The outer section, which contains the widened bore, should be at least 4 mm, advantageously between 4 and 6 mm, long. The diameter of the narrower bore in the inner section of the capillary tube should amount to at most 90%, preferably at least 80%, of the diameter of the bore in the outer section.

The transition region between the inner and outer sections should either be stepped or rounded (with a radius) or should be designed with a bevel.

The lead-through is designed in such a way that in the inner section the wall-to-wall distance is as low as possible. It should amount to at most 5% of the diameter of the bore. In the region of the outer section, the wall-to-wall distance is not critical, since in this region it is necessary to create space for the soldering glass.

The lead-through advantageously comprises a plurality of parts, as is known per se, the outer part consisting of or containing niobium and the inner part consisting of or containing molybdenum (pin and filament).

FIGURES

The invention is to be explained in more detail below on the basis of a plurality of exemplary embodiments. In the drawing:

FIG. 1 shows an aspect of a metal halide lamp

FIG. 2 shows a detailed view of an end region

FIG. 3 shows a detailed view of the end region without the lead-through.

Figure 1:
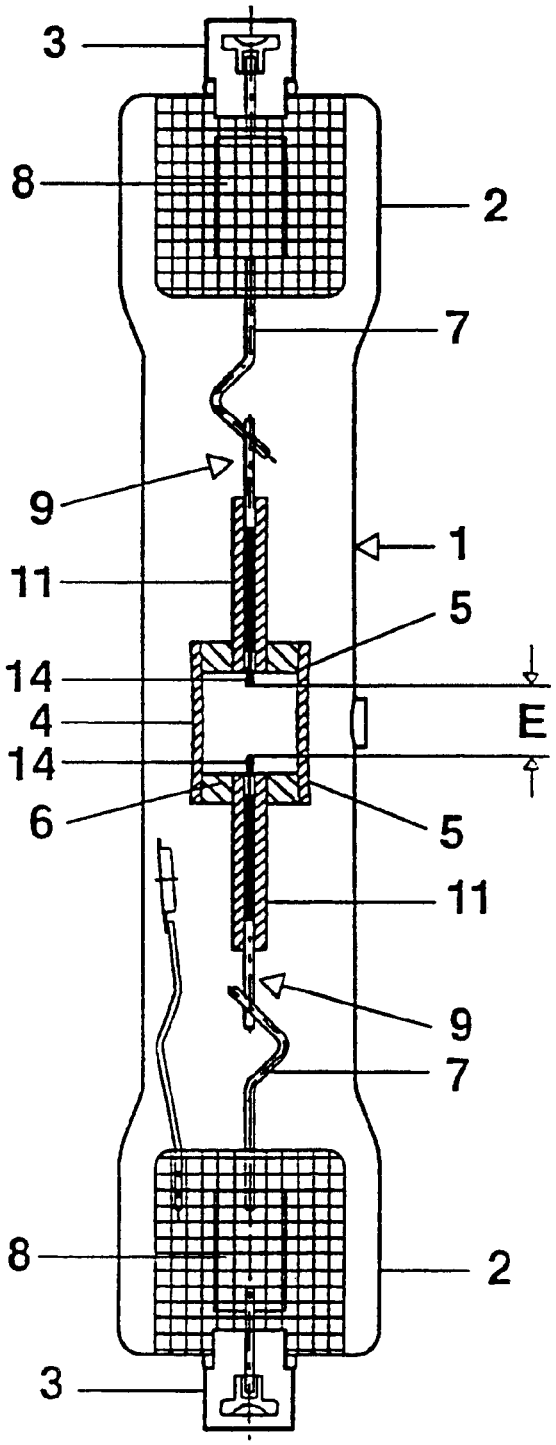
FIG. 1 diagrammatically depicts a metal halide lamp with a power of 70 W. It comprises a cylindrical outer bulb 1, which defines a lamp axis, is made from quartz glass and is pinched (2) and capped (3) on two sides. An axially arranged discharge vessel 4 made from $Al_2O_3$ ceramic is cylindrically shaped and at its ends 5 has two cylindrical stoppers 6. It is held in the outer bulb 1 by means of two supply conductors 7 which are connected to the cap parts 3 by means of foils 8. The supply conductors 7 are welded to lead-throughs 9 which are each fitted into a capillary tube 11 at the end of the discharge vessel. The capillary tube 11 is slightly more than twice as long as the distance between the electrodes E.
Figure 2:
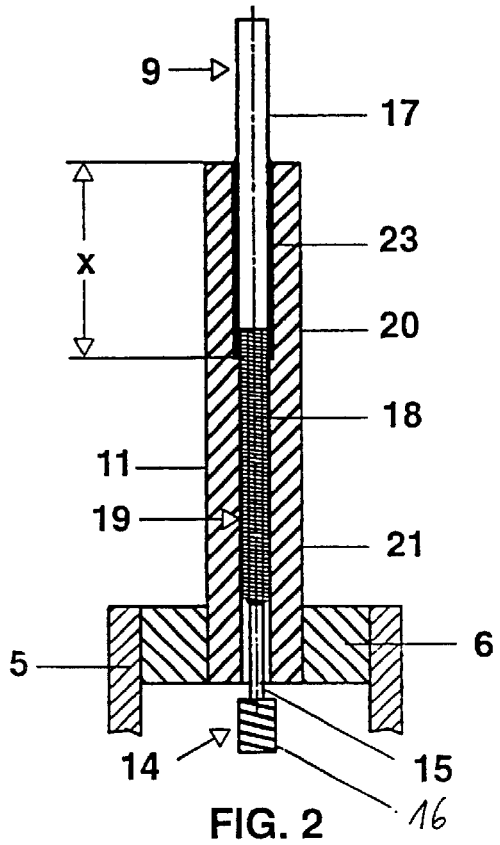

As is also shown in FIG. 2, both lead-throughs 9 project outwards beyond the capillary tube 11 and on the discharge side hold electrodes 14, comprising an electrode shank 15 made from tungsten and a filament part 16 which has been pushed on to the discharge-side end. The lead-through 9 is in each case welded to the electrode shank 15 and to the outer supply conductor 7.

In addition to an inert firing gas, for example argon, the fill of the discharge vessel comprises mercury and additions of metal halides. By way of example, it is also possible to use a metal halide fill without mercury, a high pressure being selected for the firing gas xenon.

The end stoppers 6 and the capillary tubes 11 substantially comprise, for example, $Al_2O_3$, if appropriate with doping additions such as MgO.

The capillary tube 11 is in each case sintered directly into the stopper 6. In a similar way, the stopper 6 is also sintered directly (i.e. without soldering glass) in each case into the cylindrical end 5 of the discharge vessel.

The lead-through 9 is in principle of two-part design and comprises an outer niobium pin 17 with a diameter of 0.73 mm which on the outside projects well beyond the capillary tube 11. On the discharge side, it is adjoined by a molybdenum pin 18 which is surrounded by a filament 19 of molybdenum. The external diameter of the filament 19 is 0.68 mm. On the discharge side, the electrode shank 15, the diameter of which is 0.3 mm, is attached to the molybdenum pin 18, which projects slightly from the filament 19. The filament 19 and the pin 18 extend as far as into the outer section 20 (approximately 1 to 2 mm deep, corresponding to approximately 20 to 40% of the overall length) and are therefore also surrounded by soldering glass 23. This design is advantageous since the niobium pin is unable to withstand attacks from halogen. On the other hand, the coefficient of thermal expansion of molybdenum is not suitably matched to that of the ceramic and the glass solder, so that an overlap is required (to provide protection for the niobium) while at the same time the length of the overlap must be short (on account of this lack of matching).

The filament 19 ends inside the inner section 21, specifically about 20 to 30% away from its discharge-side end. This reliably prevents backfiring of the discharge arc to as far as the inner part of the lead-through without this dead volume making its presence felt in an excessively adverse way. A soldering glass 23 for sealing purposes, which ends at a step 22, is introduced into the outer section 20.

Figure 3:
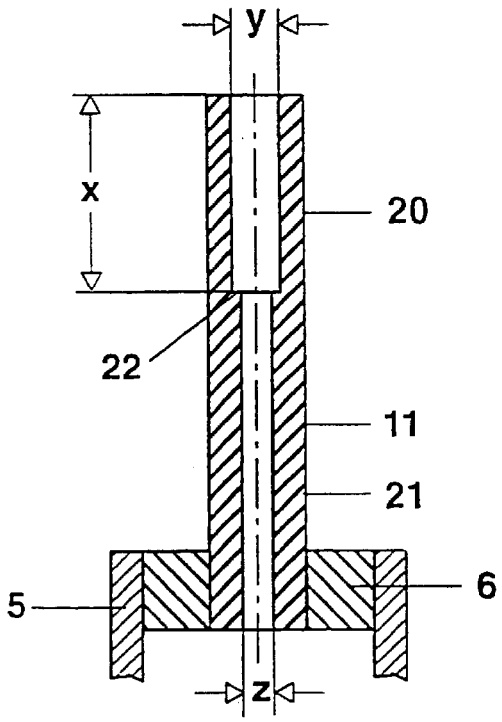

FIG. 3 shows the capillary tube 11 before the lead-through is fitted. Its total length is 12.7 mm. It comprises an outer section 20, the bore of which has a diameter y of 0.8 mm. The length x of the outer section is 5 mm. By contrast, the inner section 21 has a narrowed bore z with a diameter of 0.71 mm. The transition between the two bores is formed by the step 22.

At higher powers, the lead-through may be modified. Its inner part then comprises a cermet pin which replaces the molybdenum pin and the filament and consists of in each case approximately 50% by volume aluminium oxide and molybdenum.

What is claimed is:

1. Metal halide lamp with ceramic discharge vessel (4), the discharge vessel having two ends (5) which are closed off by sealing means which at least at one end comprise a capillary tube (11), an electrically conductive lead-through (9) being passed in a vacuum-tight manner through a bore in this capillary tube (11), to which lead-through an electrode (14) with a shank (15) is attached, which electrode projects into the interior of the discharge vessel, characterized in that the capillary tube (11) comprises two sections (20, 21) which are arranged axially one behind the other, the diameter of the bore of the inner section (21) amounting to at most 92% of the diameter of the bore in the outer section (20), and in that the lead-through (9) comprises two parts (17, 18) which lie axially one behind the other and are associated with the two sections (20, 21).

2. Metal halide lamp according to claim 1, characterized in that the length of the capillary tube (11) corresponds to at least the length of the distance between the electrodes (E).

3. Metal halide lamp according to claim 1, characterized in that the diameter of the bore of the inner section (21) amounts to at least 80% of the diameter of the bore in the outer section (20).

4. Metal halide lamp according to claim 1, characterized in that the length of the outer section is at least 4 mm.

5. Metal halide lamp according to claim 1, characterized in that the length of the outer section (20) is at most 6 mm.

6. Metal halide lamp according to claim 1, characterized in that the ratio of the lengths between the inner section (21) and outer section (20) is at least 1 and in particular is between 1 and 3.

7. Metal halide lamp according to claim 1, characterized in that the power consumption of the lamp is at most 150 W.

8. Metal halide lamp according to claim 1, characterized in that the lead-through (9), with respect to the discharge, has an inner part (18, 19) and an outer part (17), the inner part (18, 19) containing molybdenum while the outer part (17) consists of niobium.

9. Metal halide lamp according to claim 8, characterized in that the ratio between the external diameter of the inner part (19) and the diameter of the bore of the inner section is from 0.94 to 0.98.

10. Metal halide lamp according to claim 8, characterized in that the ratio between the diameter of the outer part and the diameter of the bore of the outer section is from 0.80 to 0.92.

* * * * *